United States Patent [19]

Boeke et al.

[11] 3,945,701

[45] Mar. 23, 1976

[54] WATER-TIGHT CONNECTORS FOR ELECTRIC CABLES

[75] Inventors: Uwe Boeke, Nordenham; Lothar Roland Hennemann, Enger; Wolfgang Hohorst, Minden; Horst Urban, Nordenham, all of Germany

[73] Assignee: Norddeutsche Seekabelwerke AG, Nordenham, Germany

[22] Filed: Apr. 8, 1974

[21] Appl. No.: 458,858

[30] Foreign Application Priority Data

Apr. 9, 1973 Germany ..... 2317700

[52] U.S. Cl. ..... 339/60 R

[51] Int. Cl.[2] ..... H01R 13/52

[58] Field of Search ..... 339/59–61, 339/75, 89, 90, 94, 103

[56] References Cited

UNITED STATES PATENTS

| | | | |
|---|---|---|---|
| 2,782,391 | 2/1957 | Kirk | 339/60 R |
| 3,060,417 | 10/1962 | Blake | 339/89 R |
| 3,328,744 | 6/1967 | Fiske | 339/61 R |
| 3,512,118 | 5/1970 | Leonard | 339/60 R |
| 3,514,741 | 5/1970 | Noren | 339/60 C |
| 3,590,138 | 6/1971 | Sugimoto | 339/60 M |
| 3,783,434 | 1/1974 | Ransford | 339/60 C |

FOREIGN PATENTS OR APPLICATIONS

| | | | |
|---|---|---|---|
| 1,804,945 | 11/1969 | Germany | 339/60 R |

*Primary Examiner*—Joseph H. McGlynn
*Attorney, Agent, or Firm*—Michael J. Striker

[57] ABSTRACT

Mutually mating cable contact members, on longitudinally aligned contact carriers, are surrounded by annular sealing portions of these carriers, which have annular sealing surfaces engaging each other. Said sealing portions consist of materials having different elasticities. A ring surrounds the sealing portion of greater elasticity and presses the sealing surface of this portion against the sealing portion of the other contact carrier. By the coaction of the ring with the sealing portions of different elasticities, the new connector remains water tight when submerged in deep water for extended periods of time.

18 Claims, 5 Drawing Figures

WATER-TIGHT CONNECTORS FOR ELECTRIC CABLES

BACKGROUND OF THE INVENTION

It has long been desired to construct water tight plug connectors for electric cables so as to provide a proper seal against access of water when the cable is submerged in deep water. However, serious difficulties have been encountered.

When the connectors are constructed for plugging-in only above the water, it is usual to seal the connector members by elastic gaskets against the entrance of water into the electric contact area in order to avoid grounding and short-circuiting of the contact members by any entering water. These elastic gaskets necessarily are water tight only up to a certain pressure of the surrounding water. They fail when the external water pressure overcomes the mechanical pressure which acts on the sealing gasket. Such plug connectors are therefore useful only down to limited depths of the water.

Other plug connectors are built to allow plugging in under water. Usually the insulating parts of such connectors are constructed in certain shapes and of certain materials so as to disrupt the film of water which otherwise would establish an electrically conductive connection between the surrounding water and the electric contact members. By such constructions, the plugged in connector has sufficient insulative resistance between the surrounding water and any water contained in the contact region of the plug connector. At least one of the insulating parts of such connectors is usually made of an elastic material, the elasticity of which is utilized for disrupting the aforementioned film of water.

It is a disadvantage of connectors of this latter type that continued use of the cable and repeated opening and closing of the plug connections lead to failure by fatigue of the elastic material. The resulting reduction in elastic force of this material makes this material unable to disrupt the water film during and after a new plugging-in process. It has been an additional essential drawback of such connectors, made of elastomeric material, that they could be connected only with cables insulated by elastomeric material, which is not very effective as an electric insulator.

Cable connectors for underwater plugging-in have also been proposed in certain forms designed to displace the water from the contact region during the plugging-in process. These require expensive constructions for the contact carriers with special apertures for escape of water displaced from the contact region. These constructions also require a considerable length of the contact carriers to prevent the entrance of surrounding water after the plugging-in, and they do not provide adequate contact pressure between contact members.

SUMMARY OF THE INVENTION

It is an object of the invention to overcome the above-mentioned difficulties.

It is another object to provide a water-tight plug connector for electric cables which allows repeated plugging-in, particularly under water; which can be used in deep water; and which retains the sealing effect, originally provided thereby, after extended use and repeated plugging-in operations.

Another object is to provide a water-tight plug connector of the indicated type particularly for cables insulated by a polyolefin material of high electric resistivity.

The objects have been achieved by providing contact carriers with sealing portions which consist of materials having different elasticities, with annular sealing surfaces engaging each other, and with annular means engaging the sealing portion of greater elasticity for pressing its sealing surface against the other sealing surface.

In one particular embodiment of the invention each of the aligned contact carriers has a plurality of contact members and has a single annular sealing portion surrounding said members. The sealing portions of the combined contact carriers then are pressed together by a single and relatively simple ring.

It is a further particular feature of the invention that the contact carriers are constructed in set-off form, with a support portion of larger diameter and a sealing portion of smaller diameter extending axially from the support portion. The ring or ring means engaging the sealing portion of greater elasticity can then have an outer diameter approximately equal to that of the support portion for the sealing portion of lesser elasticity.

According to one embodiment of the invention one of the contact carriers has a sealing portion consisting of elastic material and a transitional portion, suitably connected with the sealing portion and also with the cable. Particularly when the cable is insulated with polyolefin, the transitional portion can also consist of polyolefin. For connecting the transitional portion with the elastic portion a variety of intermediary members, such as a metal sleeve, can be used.

The various embodiments of the invention provide water-tight sealing for plug connectors usable in water down to great depths. The construction retains its water-tight sealing characteristic for long periods of time, also when the plug connections are opened and closed repeatedly, above the water or under water. At the same time the construction is particularly simple and inexpensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
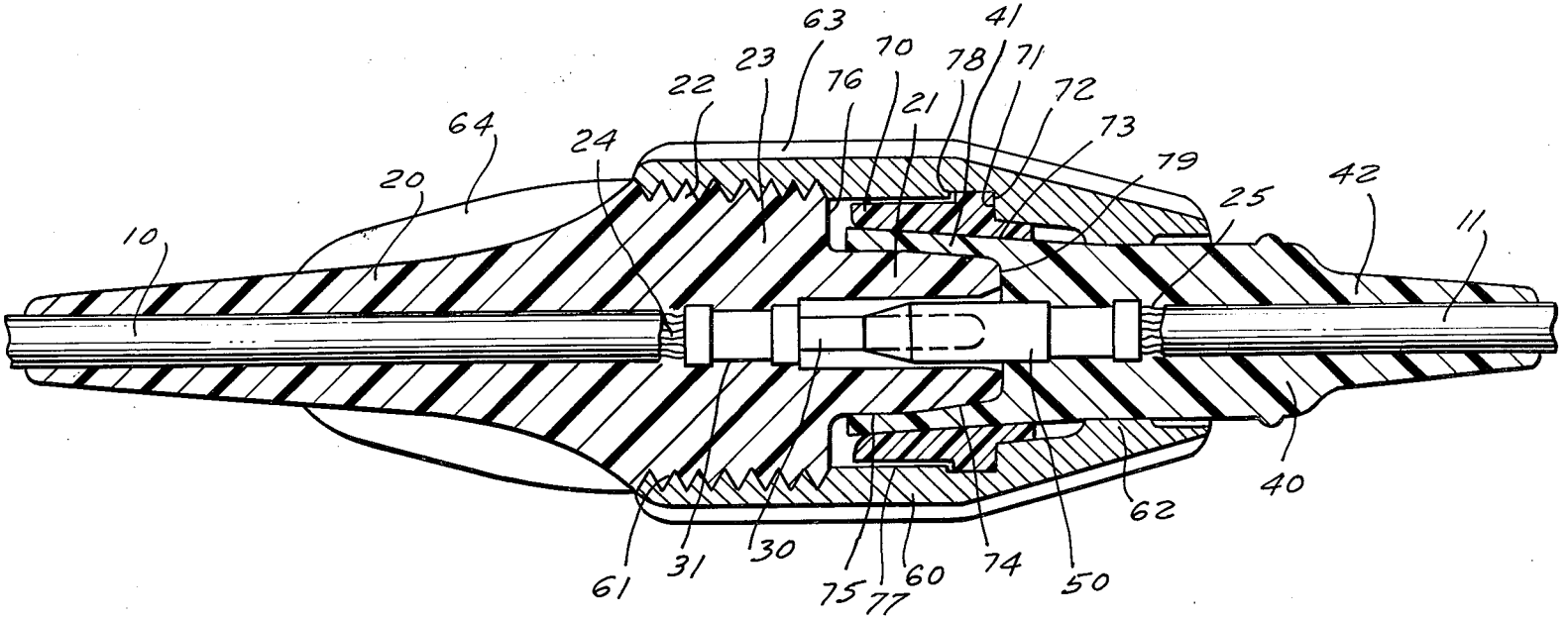
FIG. 1 is a central longitudinal section through a first embodiment of the invention.

As shown in FIG. 1, a first cable 10 has a first contact carrier 20 thereon and has a first contact member, particularly a plug 30 molded into the contact carrier 20 with a water-tight seal at 31, against any access of water from around the member 30 into the contact carrier 20. A second and opposite cable 11 has a second contact carrier 40, with a second mating contact member or socket 50 thereon and similarly molded into it. The electrical conductors 24, 25 of cable end portions 10, 11 respectively are suitably welded or soldered or otherwise connected, the one with plug 30 and the other with socket 50.

According to the invention at least sealing portions 21, 41 of contact carriers 20 and 40 respectively, and which respectively surround the contact members 30 and 50, consist of materials of different elasticity. For example in the embodiment of FIG. 1 the entire second contact carrier 40, including its sealing portion 41, consists of material more elastic than the material of the opposite sealing portion 21 and the entire first contact carrier 20. This more elastic portion 41 is formed as a socket, receiving the other contact carrier portion 21.

In further accordance with the invention an annular pressure member 70 engages an outer surface 73 of the more elastic sealing portion 41 so as to press this latter portion radially against the inner sealing portion 21 inserted therein. For this purpose a rigid coupling nut 60 has interior threads 61 in one end portion of the nut engaging exterior threads 22 on an enlarged portion 23 of the first contact carrier 20, while another end portion 62 of coupling nut 60, opposite threads 61, is arranged for sliding contact with an outer surface of the second contact carrier 40. Shoulders 71, 72 are formed coaxially in coupling nut 60 and on the annular pressure member 70, respectively so that when coupling nut 60 is threaded onto the first contact carrier 20 the nut causes sliding of the annular pressure member 70 in one axial direction (as shown, toward left). Mating surface portions 73 in the annular pressure member 70 and on the more elastic sealing portion 41 have frustoconical form so that the axial leftward sliding of annular pressure member 70 presses inner surface portions 74, 75 of the more elastic sealing portion 41 against mating outer surface portions of the less elastic contact carrier portion 21, thereby producing the aforementioned radial pressure. Advantageously, ring 70 consists of synthetic plastic material less elastic than the engaged sealing portion 41, or of substantially rigid material.

In the illustrated embodiment, the surface portion 74 has frustoconical form similar to the outer surface 73 of the more elastic sealing portion 41, while surface portion 75 is cylindrical and is disposed in the endmost part of the elastic member 41, to engage a cylindrical part of the less elastic member 21 disposed between the end of the latter member and its enlarged portion 23.

Advantageously the sealing portion 21 is offset from the enlarged contact carrier portion 23 to such extent that the resulting shoulder 76, facing the annular pressure member 70, provides sufficient room for that member in an approximately cylindrical portion 77 of the coupling nut 60 coaxial with threads 61 and having a slightly smaller inner diameter than these threads. As also shown, shoulders 78 are formed on member 70 and in portion 77 of coupling nut 60 and are arranged so that when this nut is unthreaded from the first contact carrier 20 the annular pressure member 70 is thereby displaced (as shown toward the right), to relieve the aforementioned radial pressure between the sealing portions 21, 41 of different elasticity.

When connectors 20 and 40 are disconnected under water, the contact members 30 and 50 are in contact with the water. When these members are then re-connected under water, by inserting plug 30 into socket 50, water is displaced thereby from the space in the socket and around the plug, along the surface portions 74 and 75 which at this time are not in hermetically sealing contact with one another because of the relatively elastic nature of the outer sealing portion 41. The displaced water escapes readily between threads 22 and 61.

The coupling nut 60 is then threaded onto the first contact carrier 20; for this purpose ribs 63, 64 may be formed on the coupling nut and contact carrier respectively. The threading-on of the coupling nut 60 does not cause further displacement of water from the space between plug 30 and the surrounding parts, particularly in the illustrated preferred embodiment wherein a shoulder 79 is formed in the second contact carrier 40, opposite the end of the first sealing portion 21, so that this portion 21 can first be manually inserted in the second contact carrier 40 all the way to shoulder 79. However, importantly, the threading-on and tightening of coupling nut 60 causes leftward sliding of annular pressure member 70 and thereby establishes high and distributed radial pressure between the sealing portions 41, 21, in such a way that the more elastic portion 41 fully adapts itself to the outer surface of the less elastic portion 21 and hermetically seals the space within these portions from the surrounding water, thereby safely electrically insulating the inter-engaged contact members 30 and 50 from the surrounding water.

The dimensions of the sealing portions 21 and 41, existing in the absence of pressure applied to the more elastic portion 41 by ring 70, can be such that the more elastic portion 41 is not subjected to tension by the mere insertion of the less elastic portion 21. The entire sealing pressure between the sealing portions 21, 41 is then established by pressing the pressure ring 70 onto the more elastic portion 41, that is, by threading-on and tightening the coupling nut 60. However, it is also possible to so dimension the sealing portions 21, 41 as to cause elastic deformation of the latter incident to the initial plugging-in. In this event the resulting initial tension of the elastic material of portion 41 contributes to the ultimate sealing pressure.

Figure 2:
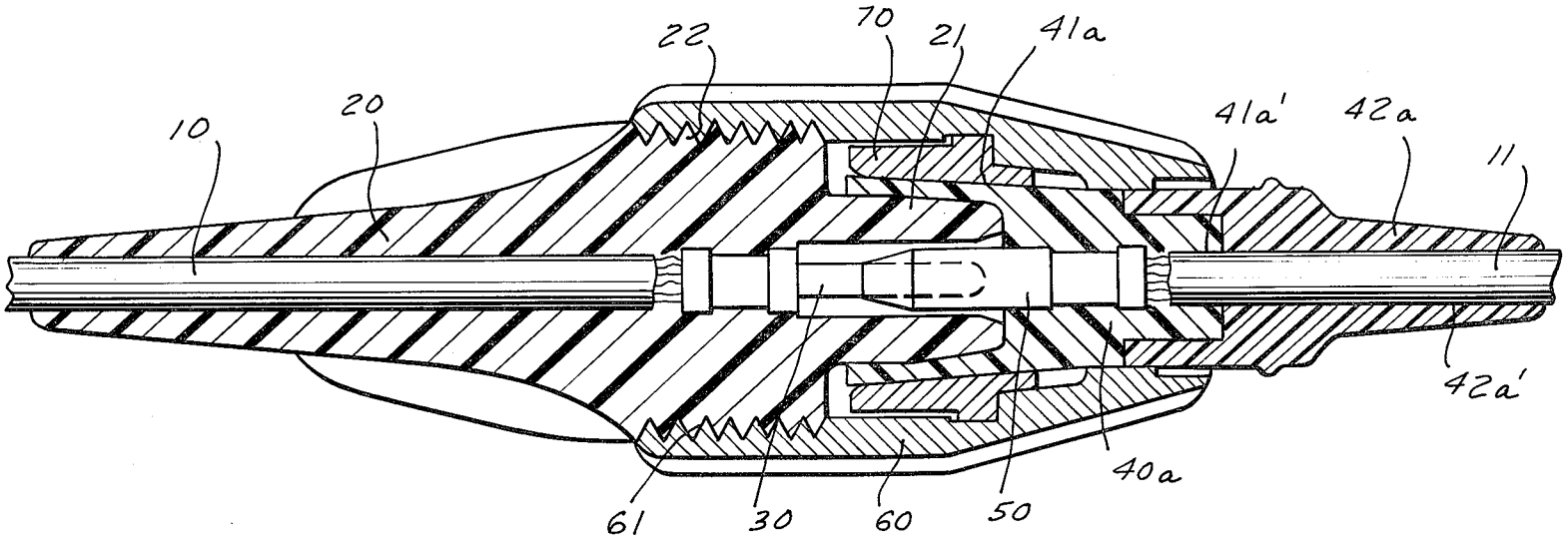
FIG. 2 is a similar section through a second embodiment.

Referring now to FIG. 2: In this embodiment the second contact carrier 40*a* again has a sealing portion 41*a* of relatively high elasticity but also has a transitional portion 42*a* consisting of a material which facilitates water-tight bonding of inside surfaces of this portion to outside insulator surfaces of cable 11, these surface portions being indicated at 42*a*'. Advantageously the insulating material of the cable is a polyolefin and the material of transitional portion 42*a* (as well as the material of the first contact carrier 20) also is a polyolefin or a copolymer thereof, which can be bonded with the cable insulation in water-tight manner. In addition, water-tight bonding is advantageously provided between the relatively elastic sealing portion 41*a* and the transitional portion 42*a*, for example along a surface 41*a*'.

Figure 3:
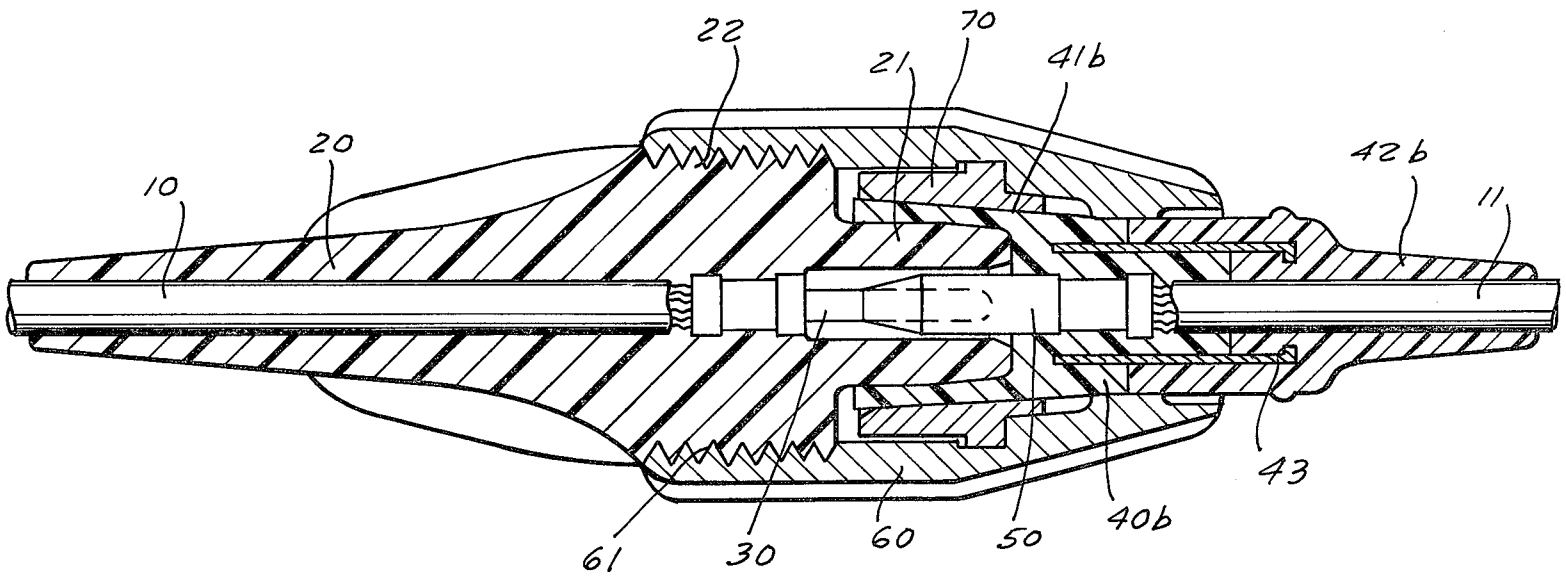
FIG. 3 is a similar section through a third embodiment.

Another embodiment particularly suitable for cables with polyolefin insulation is shown in FIG. 3. Here the relatively elastic sealing portion 41*b* of the second contact carrier 40*b*, as well as the transitional portion 42*b*, may be made of polyolefins or of polyolefin copolymers, for water-tight bonding to the insulation of cable 11. These portions 41*b*, 42*b* are interconnected with the aid of an intermediate member 43, shown as a metal sleeve. Jet molding procedures known to the art may be used for bonding contact carrier portion 42*b* to cable 11.

Figure 4:
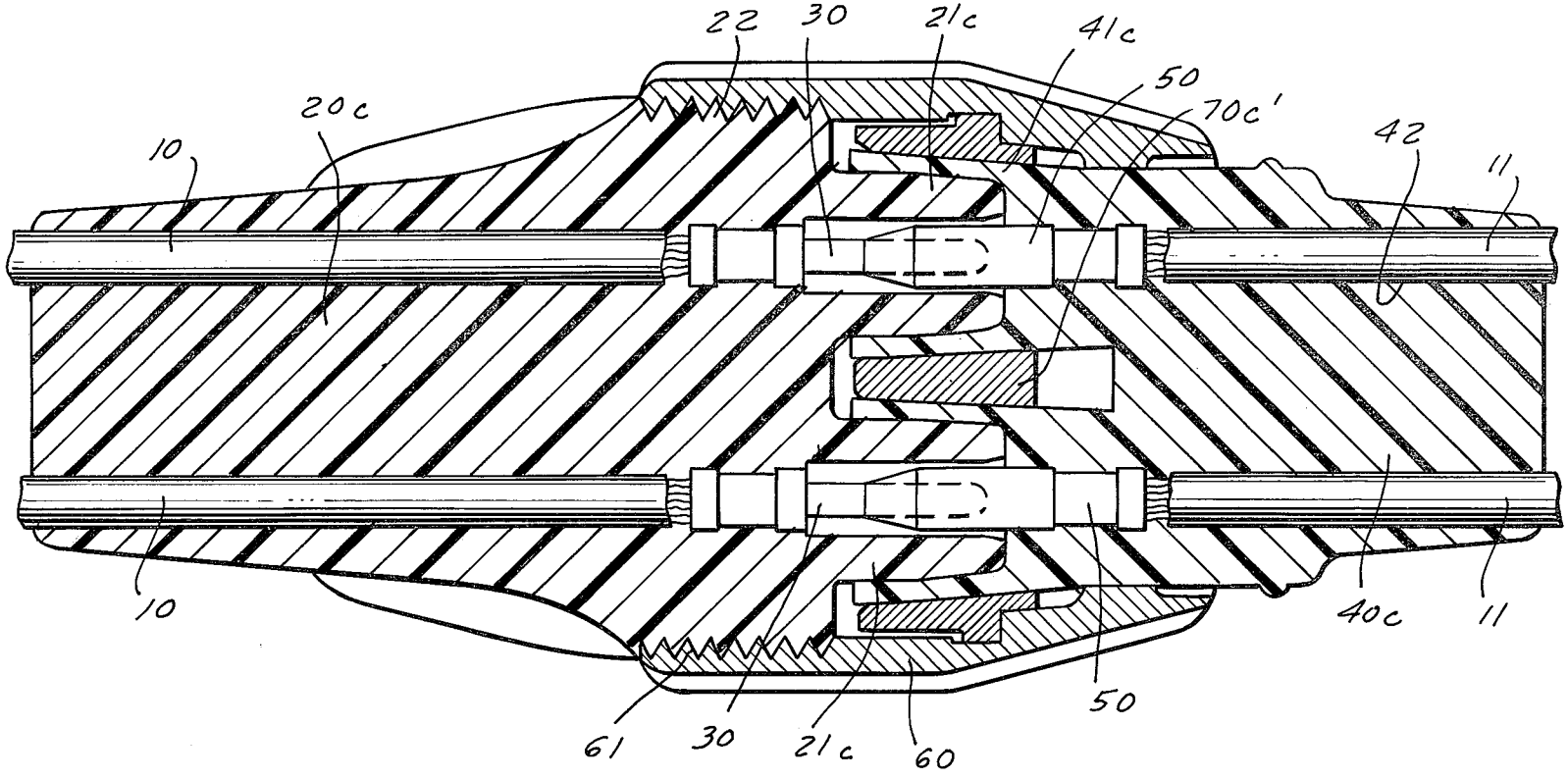
FIG. 4 is a similar section through a fourth embodiment.

In the embodiment shown in FIG. 4 the first and second contact carriers 20*c*, 40*c* have a plurality of contact members, again shown respectively as plugs 30 and sockets 50. The contact carriers 20*c*, 40*c* have a plurality of sealing portions 21*c*, 41*c* respectively, each surrounding one of the contact members and each projecting from a larger part of the corresponding contact carrier. In this embodiment the annular pressure member 70*c* desirably has a plurality of circular apertures therein.

Figure 5:
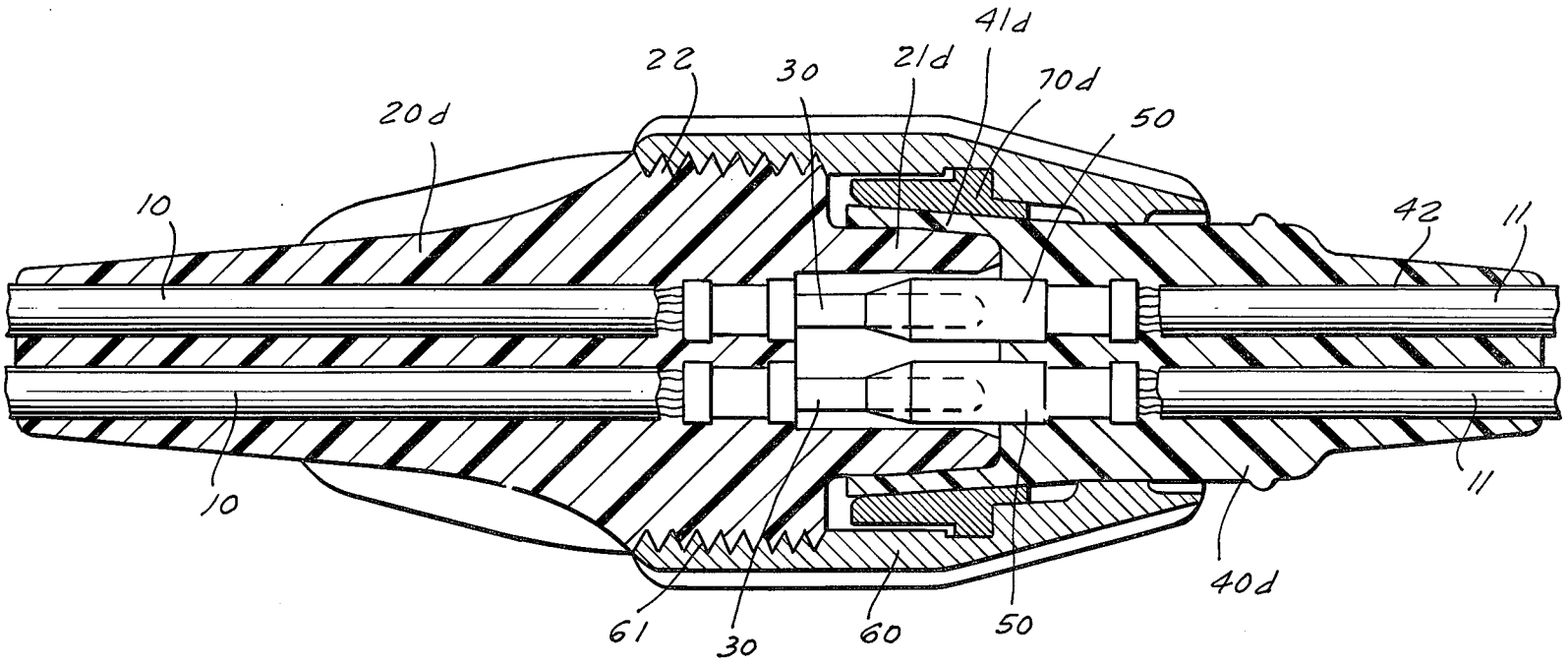
FIG. 5 is a similar section through a fifth embodiment.

Referring finally to FIG. 5: This last embodiment, like that of FIG. 4, provides a plurality or set of contact plugs 30 and contact sockets 50 respectively on the first and second contact carriers 20*d*, 40*d*, but each set, not each individual plug and socket, is surrounded by a sealing portion 21*d*, 41*d* common to these several contact members. A common annular pressure member 70*d*, with a single coaxial circular aperture, is provided in this case.

It will be understood that each of the elements described above, or two or more together, may also find a useful application in other types of cable connectors differing from the types described above.

While the invention has been illustrated and described as embodied in water-tight connectors for electric cables, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

We claim:

1. An underwater cable connector having cooperating portions which are required to be engageable and dieengageable while in submerged condition, comprising longitudinally aligned contact carriers having annular sealing portions engaging each other one of said sealing portions surrounding the other of said sealing portions and being formed of a material having a greater elasticity than said other sealing portion; mutually mating cable contact members on said carriers and being surrounded by said sealing portions; and means for expelling water from said cable contact members in response to engagement of said contact carriers so as to expel water from between said sealing portions and prevent the existence of an electrically-conductive film of water which would otherwise establish a current path connecting the cooperating portions of the cable connector with the surrounding body of water.

2. Apparatus as defined in claim 1, wherein at least portions of said sealing surfaces are substantially conical.

3. Apparatus as defined in claim 1, wherein at least portions of said sealing surfaces are substantially cylindrical.

4. Apparatus as defined in claim 1, wherein said annular means consists of material of less elasticity than the sealing portion engaged thereby.

5. Apparatus as defined in claim 1, wherein said annular means is substantially rigid.

6. Apparatus as defined in claim 1, including, on each of said contact carriers, a plurality of said contact members and a similar plurality of annular sealing portions, each surrounding one of said members.

7. Apparatus as defined in claim 1, including, on each of said contact carriers, a plurality of contact members and a single annular sealing portion surrounding said members.

8. Apparatus as defined in claim 1, wherein at least one of said contact carriers consists of a polyolefin.

9. Apparatus as defined in claim 1, wherein at least one of said contact carriers consists of a polyolefin copolymer.

10. Apparatus as defined in claim 1, wherein one of said contact carriers comprises several portions consisting of different materials, one of said several portions being the sealing portion of greater elasticity and consisting of an elastomer, and another of said several portions being a transitional portion between said sealing portion and the cable.

11. Apparatus as defined in claim 10, including a metal sleeve interconnecting said sealing portion with said transitional portion, the latter consisting of a polyolefin and being bonded to one of said cables, said metal sleeve having end portions respectively embedded in said polyolefin transitional portion and said elastomeric sealing portion.

12. Apparatus as defined in claim 11, wherein the other contact carrier also consists of a polyolefin.

13. A cable connector for interconnecting electric cables normally submerged in deep water and for establishing a seal to prevent access of such water to interior parts of the cables, comprising longitudinally aligned contact carriers having annular sealing portions with annular sealing surfaces engaging each other, one of said sealing portions surrounding the other of said sealing portions and being formed of a material having a greater elasticity than said other sealing portion; mutually mating cable contact members on said carrier surrounded by said sealing portions; and annular means engaging said one sealing portion of greater elasticity and comprising a ring and a coupling nut, both having at least portions surrounding at least parts of said contact carriers, said coupling nut treadedly engaging one of said contact carriers and having shoulders to abut said ring for shifting the latter along and against said one sealing portion of greater elasticity for pressing the sealing surface of the latter portion in the radial direction against the sealing surface of said other sealing portion, so as to expel water from between said sealing portions and prevent the existence of an electrically-conductive film of water which would otherwise establish a current path connecting the interior of the cable connector with the surrounding body of water.

14. Apparatus as defined in claim 13, wherein one of said contact carriers has an enlarged support portion, threadedly engaging said coupling nut.

15. Apparatus as defined in claim 14, wherein said ring has an outer diameter slightly smaller than the outer diameter of said support portion.

16. Apparatus as defined in claim 14, wherein said support portion consists of material of less elasticity than said sealing portion of greater elasticity.

17. Apparatus as defined in claim 16, wherein said support portion consists of polyolefin.

18. Apparatus as defined in claim 16, wherein said coupling nut consists of metal.

* * * * *